US005851031A

United States Patent [19]

Golson

[11] Patent Number: 5,851,031

[45] Date of Patent: Dec. 22, 1998

[54] FOLD-OUT BOOK JACKET

[75] Inventor: J. Geoffrey Golson, New York, N.Y.

[73] Assignee: Simon & Schuster, Inc., New York, N.Y.

[21] Appl. No.: 730,521

[22] Filed: Oct. 11, 1996

[51] Int. Cl.[6] ..... B42D 3/04

[52] U.S. Cl. ..... 281/19.1; 283/34

[58] Field of Search ..... 283/34; 402/79; 281/19.1, 37, 29, 51; 40/904; 434/130, 150, 153

[56] References Cited

U.S. PATENT DOCUMENTS

| | | | |
|---|---|---|---|
| 3,318,618 | 5/1967 | Mullen et al. | 281/29 |
| 4,305,605 | 12/1981 | Vine | 281/35 |
| 4,519,630 | 5/1985 | Holmes | 281/19.1 X |
| 4,577,890 | 3/1986 | Boyett | 281/19.1 X |
| 4,605,245 | 8/1986 | Weaver | 281/34 |
| 4,614,364 | 9/1986 | Bortner | 281/34 X |
| 4,715,619 | 12/1987 | Sloot | 281/19 |
| 4,962,951 | 10/1990 | Mechesney | 283/114 |
| 5,029,899 | 7/1991 | Schieppati et al. | 281/30 |
| 5,030,027 | 7/1991 | Bachrach et al. | 281/37 X |
| 5,380,043 | 1/1995 | Schwartz | 281/5 |
| 5,419,586 | 5/1995 | Golson | 283/34 |

*Primary Examiner*—Willmon Fridie, Jr.
*Attorney, Agent, or Firm*—Pennie & Edmonds LLP

[57] ABSTRACT

A book jacket with flaps folding over the front and rear covers of a book, having informative indicia located on the inner surface of the flaps such that when the flaps are folded out, the informative indicia will be juxtaposed with the book and will be concurrently visible to the user as he views the pages of the book. The informative indicia provide information to help the user of the book interpret the information in the book. For example, the informative indicia may be: a family tree for a book involving a complex genealogy, a timeline of events for a book on history, or a legend of map symbols for an atlas or road map book. The informative indicia may be printed directly on the inner surface of the flap, or may be provided on a separate sheet which is attached to the inner surface of the flap. If there is a great deal of information to be provided, an elongated folded flap may be employed.

18 Claims, 2 Drawing Sheets

FOLD-OUT BOOK JACKET

TECHNICAL FIELD

This invention generally relates to flexible book jackets that can be placed around books. More particularly, the invention relates to flexible book jackets which provide informative indicia which assist the user of a book in interpreting the information in the book.

BACKGROUND OF THE INVENTION

This invention relates to flexible book covers or jackets which are used to provide protection for the exterior binding of a book, and which may be easily installed on or removed from a given book. Jackets of various types for both hardcover and softcover books are well known. Such covers may be made of paper, leather, plastic or other suitable flexible material. Jackets may be transparent, allowing observation of the book binding, or opaque, in which case the jacket itself may provide a decorative or informative function.

The standard book jacket is a simple rectangle of thin, flexible, foldable continuous sheet material, approximately the same height as the book to be covered, and of sufficient width to span the binding of the book (including the front and rear covers and the spine) and to provide flaps which fold over the edges of the book's front and rear covers. The jacket is provided with decorative or informative material on the exterior surface. Typically, the jacket is printed with information such as the title of the book, art work, the author's name, and the publisher, on the regions of the exterior surface of the jacket that are visible when the book is closed (this being the regions of the jacket adjacent the outer surfaces of the front and rear covers, and the spine). When the front or rear cover of the book is opened, the flaps of the jacket are visible. These flaps often carry a brief synopsis or review of the contents of the book, or a biography of the author.

Books often contain complex information such that the user can benefit from a brief guide, index, or summary which will assist in understanding the contents of the book. Well-known examples include tables of contents, lists of graphical icons keyed to the contents of the book, word indices, glossaries or keyword definitions, legends to explain map symbols, family trees to illustrate genealogical relationships, or timelines to illustrate a chronology of historical events. Such informative indicia are often provided on a page near the front or rear of the book. The problem with placing the informative indicia on a page in the book is that it is inconvenient and time consuming for the user to have to flip back and forth between the page containing the information of interest and the page containing the informative indicia. Such indicia are most conveniently used when viewed concurrently with the contents of the book.

It is also known to place informative indicia on the exterior surfaces of the front or rear flaps of the jacket. However, this does not solve the problem discussed above, as it still forces the user to flip back and forth between the page of interest and the jacket flap.

It is known to place informative indicia on the inner surface of a rigid fold-out book cover. U.S. Pat. No. 5,419,586 to the present inventor shows a volume of cartographic material having a front cover comprising two substantially rigid panels, hingedly connected. A binding mechanism binds the cover to the leaves to form the volume. One of the panels, when folded out, displays small scale cartographic indicia and key grid indicia overlying the cartographic indicia. The indicia on the panel are directed to the pagination of the cartographic volume, and to scale comparisons, not with any legend symbology.

There are significant advantages to providing the informative indicia on the inner surface of a flexible book jacket rather than on the inner surface of a rigid panel of a book cover. Producing a rigid foldable cover adds to the cost of producing such a book. Furthermore, due to the thickness of rigid book cover panels, a fold-out cover as shown in U.S. Pat. No. 5,419,586 will significantly add to the thickness and weight of the final volume. In contrast, after the printing of the informative indicia is accomplished, the fold-out flexible book jacket of the present invention does not add any meaningful manufacturing complexity, cost, weight, or thickness to the final volume.

It is an object of the present invention to provide informative indicia which are concurrently visible with the pages of the book, without adding significantly to the cost of the book and without adding significantly to the weight or bulkiness of the book.

It is a further object of the invention to provide informative indicia which are integral to a flexible book jacket.

It is yet another object of the invention to provide a cartographic symbol legend integral to the flexible jacket of an atlas, such that the symbol legend is concurrently visible when the user is viewing the pages of the atlas.

SUMMARY OF THE INVENTION

The present invention is directed to a book jacket with flaps folding over the front and rear covers of a book, having informative indicia located on the inner surface of the flaps such that when the flaps are folded out, the informative indicia will be positioned alongside the book and will be concurrently visible to the user as he views the pages of the book. The informative indicia may be printed directly on the inner surface of one or both of the flaps, or may be provided on one or more separate sheets which are attached to the surfaces of one or both of the flaps.

In one preferred embodiment, the jacket is used in conjunction with a cartographic volume, and the informative indicia, comprising cartographic legend indicia, are printed directly on the inner surface of the flap of the jacket.

DETAILED DESCRIPTION OF THE PREFERRED EMBODIMENTS

Figure 1:
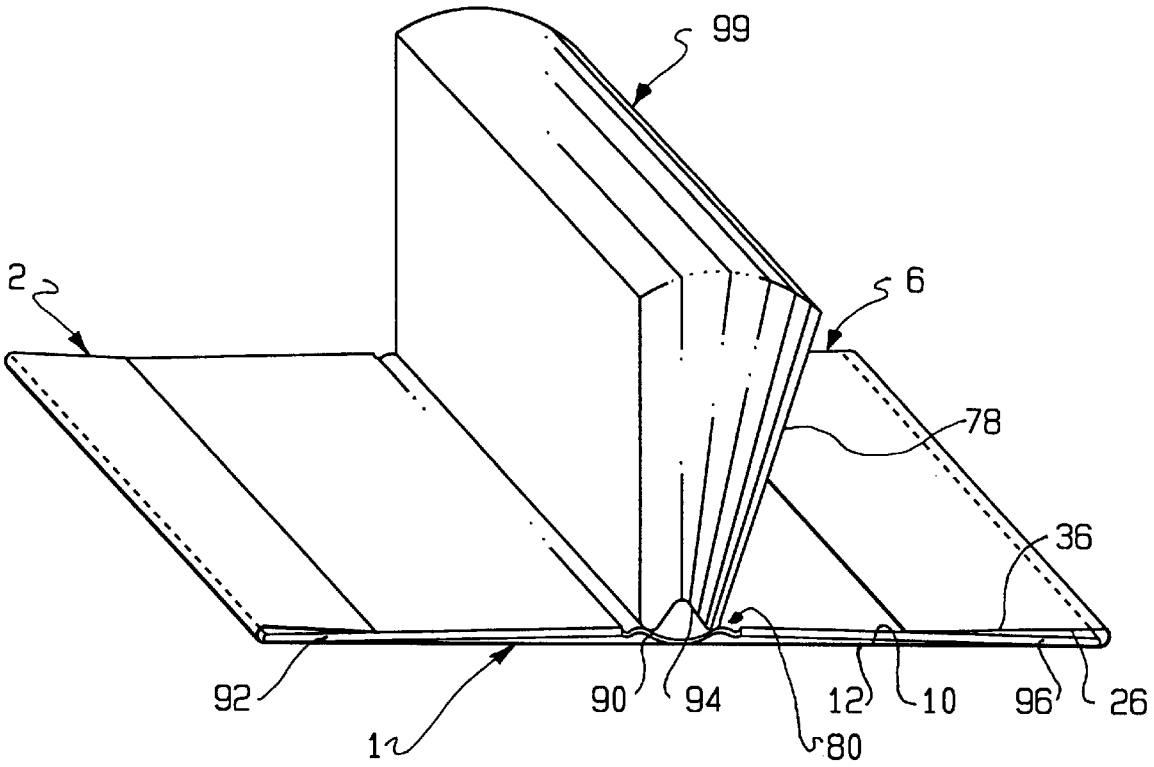
FIG. 1 is a perspective view of the book jacket of the present invention applied to a book.

A book jacket according to the present invention is illustrated in FIG. 1. The book jacket 1 covers a standard book 99. The book has an exterior binding 90 which includes a front cover 92, spine 94, and rear cover 96. The jacket 1 is of a height generally matching the height of the book, and is of sufficient width to span the binding and to provide flaps 2 and 6 which fold over the edges of the covers 92 and 96 respectively.

Although the following discussion will focus on the rear cover and associated flap, the explanation is fully applicable to the front flap as well. For convenience, the term "interior surface" will be used to refer to the surface 10 of the jacket which is generally in contact with the book binding, and the term "exterior surface" will be used to refer to the surface not in contact with the book binding. However, it will be seen that practicing the invention will involve taking part of the interior surface 10 out of contact with the book binding.

The rear jacket flap 6 is shown in the conventional position in FIG. 1. The rear flap has an exterior surface region 36 and an interior surface region 26. In this known configuration, the exterior surface region 36 is visible to a user of the book only when the user flips the pages of the book away from the rear cover 96 such that the rear cover and rear flap are visible as illustrated. However, when the user is examining the pages of the book, the rear flap will be obscured by the pages lying on top of it.

Figure 2:
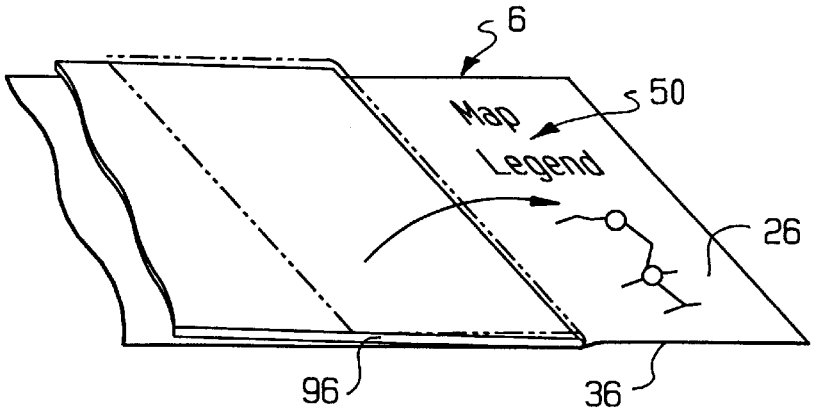
FIG. 2 is a perspective broken-away view of the book jacket with the rear flap folded out.

When the flap 6 of the jacket of the present invention is folded out, as shown in FIG. 2, the interior surface 26 of the flap is exposed and positioned alongside the book cover.

Figure 3:
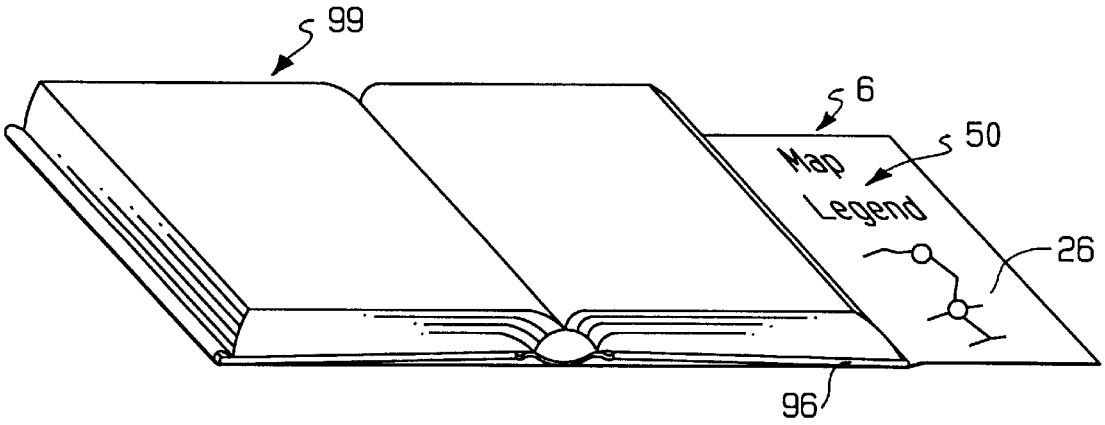
FIG. 3 is a perspective view of the book jacket with the rear flap folded out and the book opened for use.

Therefore, the interior surface 26 of the flap is both juxtaposed with and concurrently visible with the pages of the book, as shown in FIG. 3. According to the present invention, informative indicia 50 is provided on the interior surface 26 of the flap 6, by printing or other suitable methods. This placement of the informative indicia 50 allows the user of the book to easily refer to the informative indicia at the same time as he is examining the pages of the book.

In the illustrated embodiment, the informative indicia 50 consists of a map legend, providing a convenient reference of cartographic symbols for a user of a cartographic book such as an atlas. The legend will be continuously and conveniently visible to the user as he flips from one map page to another.

The flap 6 in the embodiment illustrated in FIG. 2 may be wider than the typical flap. By making the flap wider than usual, a larger area is available on the interior surface 26 on which to provide the informative indicia 50. Referring momentarily to FIG. 1, it may seem that the width of the book jacket flap 6 is limited to the width of the cover 96, as a wider flap would come up against the corner 80 where the last page 78 and the cover 96 meet. This would limit the space available to provide informative indica. However, if a flap having a width greater than that of the cover is desired, in order to provide a larger surface area for the informative indicia, this can be achieved by a folded flap.

Figure 4:
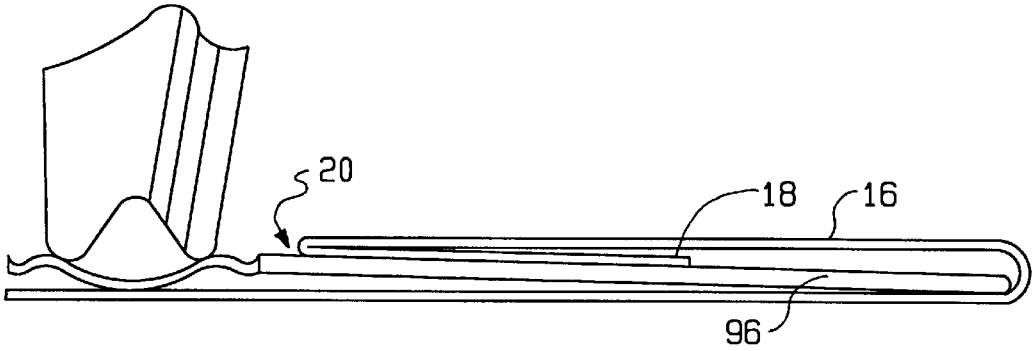
FIG. 4 is a broken-away elevation view of a rear cover of a book with a book jacket having a double-folded flap.

FIG. 4 illustrates a folded flap according to the present invention, in the folded position. This folded flap has two sections 16 and 18 separated by a fold 20. In the illustrated embodiment, each section is approximately the same width as the cover 96. When in the unfolded position (not illustrated), this folded flap will provide a surface area approximately twice as wide as the cover 96, upon which informative indicia may be placed. It is evident that by the use of additional folds, even greater surface areas can be made available for placement of the informative indicia without adding significant cost, weight, or bulkiness to the book.

Figure 5:
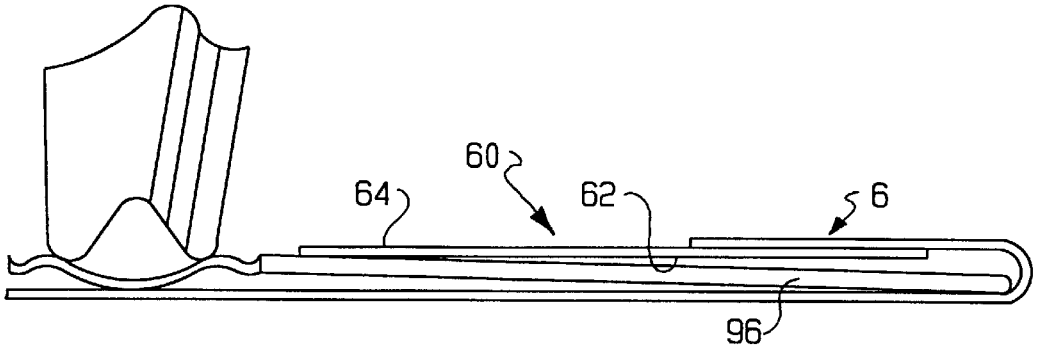
FIG. 5 is a broken-away elevation view of a rear cover of a book with a book jacket having a separate sheet attached to the rear flap.

The informative indicia may also be provided on a separate sheet which is affixed to the jacket flap. FIG. 5 illustrates a sheet 60 having an interior side 62 and exterior side 64. In this embodiment, the informative indicia is provided on the interior side 62 of the sheet by printing or other suitable methods. The sheet is affixed to the flap 6 by adhesives or other suitable methods. This embodiment permits the sheet 60 to be made from a different material than the jacket 1. It is also advantageous in that it allows the sheet to be prepared separately from the jacket, which may be desired, for example, when the information for the informative indicia becomes available only after the jacket has already been prepared.

While specific embodiments of the invention have been described and shown in the drawings, further variations will be apparent to those skilled in the art, and the invention should not be construed as limited to the specific forms shown and described. The scope of the invention is to be determined solely by the following claims.

What is claimed is:

1. A book jacket of flexible, foldable sheet material for covering the exterior binding of a book, comprising at least one flap foldable relative to the edge of the book binding cover, said flap having informative indicia provided on its interior surface such that by folding out said flap, the informative indicia are visible to a user of the book and are juxtaposed with pages of the book when opened, allowing the user to view the informative indica concurrently with the pages of the book.

2. The book jacket of claim 1, wherein the book jacket covers a book of cartographic material, and the informative indicia comprises cartographic indicia.

3. The book jacket of claim 2, wherein the cartographic indicia comprises a map legend.

4. A book jacket of flexible, foldable sheet material for covering the exterior binding of a book, comprising at least one flap foldable relative to the edge of the book binding cover, wherein informative indicia are provided on a separately formed sheet which is affixed to said flap, such that by folding out said flap and said affixed sheet, the informative indicia are visible to a user of the book, and are juxtaposed with the pages of the book when opened, allowing the user to view the informative indica concurrently with the pages of the book.

5. The book jacket of claim 4, wherein the book jacket covers a book of cartographic material, and the informative indicia comprises cartographic indicia.

6. The book jacket of claim 5, wherein the cartographic indicia comprises a map legend.

7. A book jacket of flexible, foldable sheet material for covering the exterior binding of a book, comprising at least one flap foldable relative to the edge of the book binding cover, said flap comprising a plurality of sections which are foldable relative to one another, such that when fully unfolded, the plurality of sections are arranged side by side, the interior surface of said flap having informative indicia, such that by unfolding said flap, the informative indicia are visible to a user of the book, and are juxtaposed with the pages of the book when opened, allowing the user to view the informative indica concurrently with the pages of the book.

8. The book jacket of claim 7, wherein the book jacket covers a book of cartographic material, and the informative indicia comprises cartographic indicia.

9. The book jacket of claim 8, wherein the cartographic indicia comprises a map legend.

10. A book jacket of flexible, foldable sheet material for covering the exterior binding of a book, comprising first and second flaps foldable relative to the edges of the book binding covers, wherein the book jacket has informative indicia provided on the interior surface of both said first and second flaps, such that by folding out said flaps, the informative indicia are visible to a user of the book, and are juxtaposed with the pages of the book when opened, allowing the user to view the informative indica concurrently with the pages of the book.

11. The book jacket of claim 10, wherein the book jacket covers a book of cartographic material, and the informative indicia on at least one of the flaps comprises cartographic indicia.

12. The book jacket of claim 11, wherein the cartographic indicia comprises a map legend.

13. A book jacket of flexible, foldable sheet material for covering the exterior binding of a book, comprising first and second flaps foldable relative to the edges of the book binding covers, wherein informative indicia are provided on both a first and second separately formed sheet, said first sheet being affixed to said first flap and said second sheet being affixed to said second flap, such that by folding out said flaps and said affixed sheets, the informative indicia are visible to a user of the book, and are juxtaposed with the pages of the book when opened, allowing the user to view the informative indica concurrently with the pages of the book.

14. The book jacket of claim 13, wherein the book jacket covers a book of cartographic material, and the informative indicia comprises cartographic indicia.

15. The book jacket of claim 14, wherein the cartographic indicia comprises a map legend.

16. A book jacket of flexible, foldable sheet material for covering the exterior binding of a book, comprising first and second flaps foldable relative to the edge of the book binding covers, both of said first and second flaps comprising a plurality of sections which are foldable relative to one another, such that when fully unfolded, said plurality of sections are arranged side by side, the interior surfaces of said flaps being provided with informative indicia, such that by unfolding said flaps, the informative indicia are visible to a user of the book, and are juxtaposed with the pages of the book when opened, allowing the user to view the informative indica concurrently with the pages of the book.

17. The book jacket of claim 16, wherein the book jacket covers a book of cartographic material, and the informative indicia comprises cartographic indicia.

18. The book jacket of claim 17, wherein the cartographic indicia comprises a map legend.

* * * * *